US007278624B2

(12) United States Patent
Iott et al.

(10) Patent No.: US 7,278,624 B2
(45) Date of Patent: Oct. 9, 2007

(54) AUTOMATIC FAUCET WITH POLARIZATION SENSOR

(75) Inventors: Jeffrey Iott, Monroe, MI (US); Donald K. Cohen, Farmington Hills, MI (US); James R. Disser, Oakridge, NJ (US)

(73) Assignee: Masco Corporation, Taylor, MI (US)

( * ) Notice: Subject to any disclaimer, the term of this patent is extended or adjusted under 35 U.S.C. 154(b) by 80 days.

(21) Appl. No.: 11/113,702

(22) Filed: Apr. 25, 2005

(65) Prior Publication Data

US 2006/0237674 A1 Oct. 26, 2006

(51) Int. Cl.
*F16K 31/02* (2006.01)

(52) U.S. Cl. ..... 251/129.04; 4/623

(58) Field of Classification Search ..... 251/129.04; 4/623, 304, 305, 313, 406, 668
See application file for complete search history.

(56) References Cited

U.S. PATENT DOCUMENTS

| | | | | |
|---|---|---|---|---|
| 4,682,628 | A | 7/1987 | Hill | |
| 4,762,273 | A | 8/1988 | Gregory et al. | |
| 4,984,314 | A | 1/1991 | Weigert | |
| 5,033,508 | A | 7/1991 | Laverty, Jr. | |
| 5,549,273 | A | 8/1996 | Aharon | |
| 5,566,702 | A | 10/1996 | Philipp | |
| 5,943,712 | A | 8/1999 | Van Marcke | |
| 6,202,980 | B1 | 3/2001 | Vincent et al. | |
| 6,250,601 | B1 | 6/2001 | Kolar et al. | |
| 6,273,394 | B1 | 8/2001 | Vincent et al. | |
| RE37,888 | E | 10/2002 | Cretu-Petra | |
| 6,568,655 | B2 * | 5/2003 | Paese et al. | 251/129.04 |
| 2004/0129478 | A1 * | 7/2004 | Breed et al. | 180/273 |
| 2004/0227117 | A1 * | 11/2004 | Marcichow et al. | 251/129.04 |
| 2005/0000015 | A1 | 1/2005 | Kaneko | |
| 2006/0006354 | A1 * | 1/2006 | Guler et al. | 251/129.04 |

(Continued)

FOREIGN PATENT DOCUMENTS

JP 2003096850 A 4/2003

(Continued)

OTHER PUBLICATIONS

What's a PSD, Feb. 18, 2005, 3 pages, http://www.sitek.se/whats_a_psd.htm.

(Continued)

*Primary Examiner*—J. Casimer Jacyna
(74) *Attorney, Agent, or Firm*—Woodard, Emhardt, Moriarty, McNett & Henry LLP

(57) ABSTRACT

An automatic faucet system includes a sensor and a controller. The sensor includes an emitter constructed and arranged to emit light having a first polarization toward an object. The sensor further includes a detector configured to detect light reflected from the object having a second polarization that is different from the first polarization. The controller is operatively coupled to the detector. The controller is configured to supply water to a faucet, or other water supply, upon sensing by the detector the light having the second polarization. By sensing in such a manner, the level of false positive readings in the system is reduced. The detector is further configured to determine the location of the object so that the faucet is only activated when the object is in close proximity to the faucet.

12 Claims, 12 Drawing Sheets

U.S. PATENT DOCUMENTS

2006/0124883 A1* 6/2006 Bailey ..... 251/129.04

FOREIGN PATENT DOCUMENTS

WO WO 03/029572 A1 4/2003

OTHER PUBLICATIONS

Kingbright 3.2×1.6mm SMD Chip LED Lamp, APTD3216SURC Hyper Red, Mar. 18, 2003, 4 pages.

iC-OD, iC-ODL Optical Position-Ssensitive Detector (PSD), Rev D2, pp. 1-7, Copyright © 2005 iC-Haus, http://www.ichaus.com.

How they work—Laser Triangulation Sensors, Feb. 3, 2005, 2 pages, www.sensorland.com, http://www.sensorland.com/HowPage056.html.

On-Trak—Detector Amplifiers, Dec. 15, 2004, 9 pages, http://www-cdr.stanford.edu/MADEFAST/catalogs/on-trak/psd/psd.html.

Position Sensing Detectors Theory of Operation, 2 pages, ON-TRAK® Photonics, Inc., www.on-trak.com, Lake Forest, California.

Non-contact Position Sensing Using Optical Detectors, 6 pages, UDT Instruments.

* cited by examiner

AUTOMATIC FAUCET WITH POLARIZATION SENSOR

BACKGROUND

The present invention generally relates to automatic faucet systems, and more specifically, but not exclusively, concerns an automatic faucet sensor system that utilizes light polarization in order to enhance operational reliability.

Automatic faucets are increasingly being used in public restrooms and other commercial settings in order to minimize the spread of diseases and to provide greater convenience. Without physically contacting the faucet, a user is able to operate the faucet by simply placing an extremity, such as a hand, near the faucet. Upon detection of the user's hand, the automatic faucet supplies water so that the user is able to wash their hands. Once the user's hands are removed, the water supply is shut off.

Reliability in detection of the user's hands is always a concern. If the faucet is unable to detect the presence of a hand, the faucet may not turn on when desired. In contrast, objects that create a great deal of reflection can cause the faucet to run in an uncontrolled manner. Such reflective objects can include the sink, the surrounding environment, and even the stream of water supplied by the faucet. For example, once the water is turned on, the infrared signal from the automatic faucet may reflect off the water stream, thereby causing the faucet to run continuously. Moreover, such automatic faucet systems also have trouble in adapting to different background light levels. Numerous algorithms and techniques have been developed in order to reduce the number of false readings. However, such complicated detection techniques tend to increase the cost as well as reduce the reliability of the automatic faucet. Over time, the performance of these automatic faucets tends to deteriorate.

Other types of automatic faucet systems have been developed in attempt to alleviate the above-mentioned problems, but they only have achieved some limited success. For example, systems have been proposed that use polarized light in some manner for detecting false sensor readings. However, such systems have not been able to accurately detect objects because they fail to address a number of issues associated with light intensity. The intensity of light reflected from an object is based on a number of factors, like the distance of the object from the sensor as well as the reflectivity of the object. As should be appreciated, the intensity of light reflected from a distant object is less than the intensity of light reflected from the same object at closer distances. Ambient conditions along with the reflective properties of objects can also vary the intensity of light sensed. For instance, skin complexion and/or the amount dirt or other contaminants, such as paint, on the body part to be washed can vary from person to person. With these large numbers of factors, it is hard to distinguish between an object that is located far away from the sensor from those objects that have low reflectivity, and vice versa. Shiny object, such as jewelry or watches, that are highly reflective in nature can accidentally activate the automatic faucet, even when they are located relatively far away from the sensor. Conversely, dull or dirty objects, like hands covered with dirt, might not be able to activate the automatic faucet, although they are positioned directly in front of the faucet in close proximity to the sensor. Users sometimes experience frustration by not knowing if their hands are properly positioned to activate the automatic faucet, which in turn compounds the above-mentioned sensing difficulties.

Thus, there remains a need for improvement in this field.

SUMMARY

One aspect of the present invention concerns an automatic faucet system. The system includes an emitter configured to emit light having a first polarization toward an object. A detector is configured to detect reflected light from the object having a second polarization that is different from the first polarization. The detector is configured to sense the position of the object. A controller is operatively coupled to the detector, and the controller is constructed and arranged to supply water upon sensing with the detector that the reflected light has the second polarization above a threshold level and that the position of the object is within range.

Another aspect concerns an automatic faucet system, which includes means for detecting a light scattering object. The system further includes means for sensing location of the light scattering object and means for activating a water supply upon detection that the light scattering object is located in close proximity to the system.

A further aspect concerns a method for controlling an automatic faucet. Light having a first polarization is transmitted towards an object. Light is detected that is reflected from the object having a second polarization that is different from the first polarization. Water from a faucet is supplied in response to detection of the light having the second polarization.

DESCRIPTION OF SELECTED EMBODIMENTS

Figure 1:
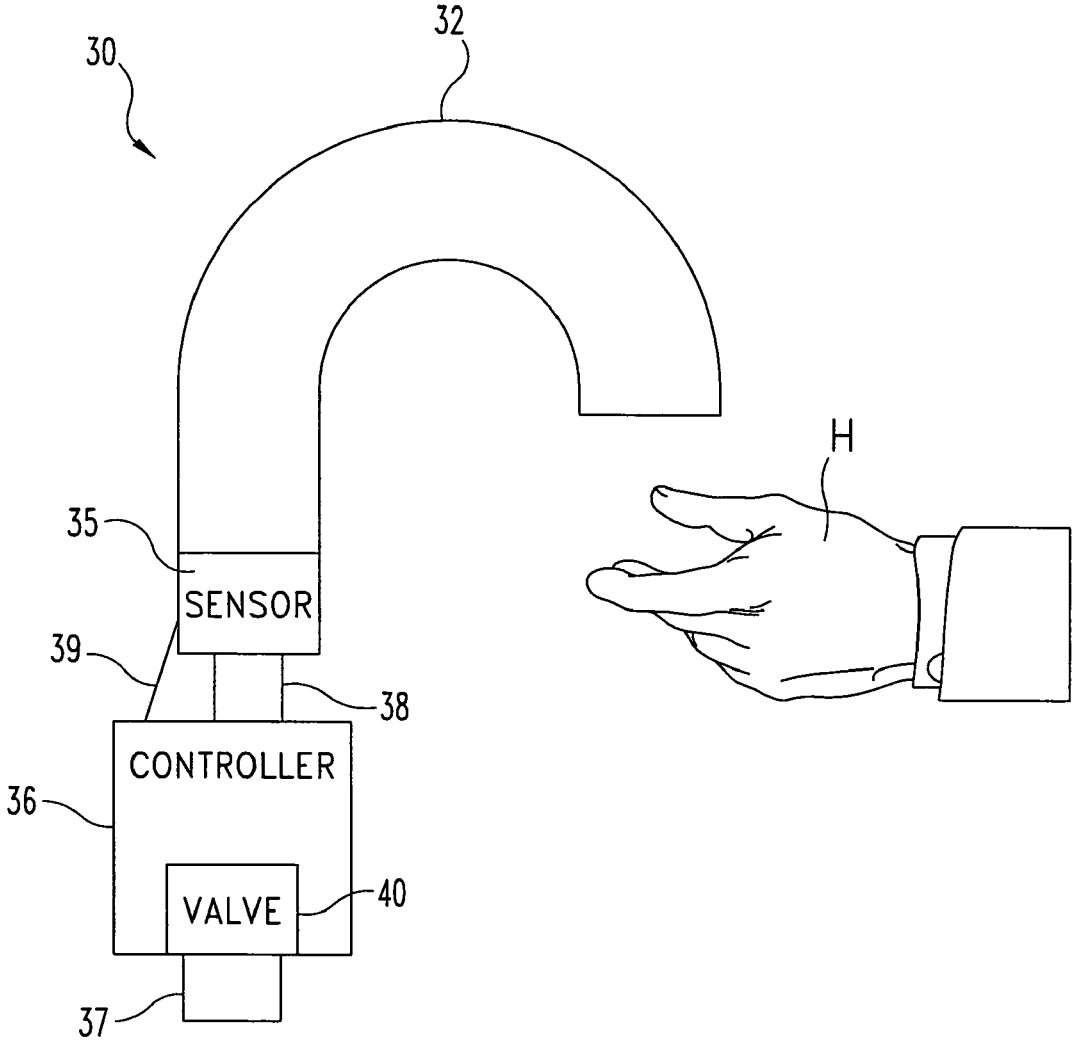
FIG. 1 is a side elevational view of an automatic faucet system according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the illustrated device, and further applications of the principles of the invention as illustrated or described herein are contemplated as would normally occur to one skilled in the art to which the invention relates. One embodiment of the invention is shown in great detail, although it will be apparent to those skilled in the art that some of the features which are not relevant to the invention may not be shown for the sake of clarity.

FIG. 1 illustrates an automatic faucet system 30 according to one embodiment (of many) of the present invention. As shown, the faucet system 30 includes a faucet spout 32, a sensor system 35 for detecting the presence of a body part (or some other object), such as a hand H, and a controller 36, which is used to control water flow from the spout 32. Although the illustrated embodiments will be described with reference to an automatic faucet, it should be appreciated that selected features can be adapted for use in other fields, such as with automatic showers, toilets and the like. A water supply pipe 37 supplies water to the controller 36. Extending between the controller 36 and the spout 32, a spout pipe 38 supplies water from the controller 36 to the spout 32. The controller 36 is operatively coupled to the sensor system 35 through an operative connection 39. By way of nonlimiting examples, the operative connection 39 can include electrically conductive wires, fiber optic cabling, and/or wireless transmissions, to name a few. In one embodiment, the operative connection 39 includes electrically conductive wires. As noted above, the controller 36 controls the water flow to the spout 32 by detecting the presence of the user's hand H via sensor system 35. For instance, when the user's hand H is placed underneath the faucet spout 32, the sensor 35 senses the hand H, and in turn, the controller 36 allows water to flow from the spout 32. After the hand H is removed from underneath the spout 32, the controller 36 shuts off the water supply to the spout 32. The controller 36 includes electronics that are used to control the water flow from the spout 32. For the sake of brevity and clarity, the components of the controller 36 will not be described herein. For a detailed description of some examples of these components, please refer to U.S. Pat. No. 6,202,980 issued on Mar. 20, 2001 to Vincent et al., and U.S. Pat. No. 6,273,394 issued on Aug. 14, 2001 to Vincent et al., which are hereby incorporated by reference in their entirety. In the illustrated embodiment, the controller 36 includes at least one valve 40 that controls the water flow. Although the valve 40 in FIG. 1 is shown as being incorporated in the controller 36, it should be recognized that the valve 40 can be a separate component that is remotely located from the controller 36.

As mentioned above, previous automatic faucet sensor systems have difficulty in detecting the presence or absence of hands within a sink due to reflectance from the sink, the surrounding environment, and/or the water stream flowing from the faucet. In the sensor system 35, according to one embodiment, light polarization is used for detecting the presence or absence of the user's hand H. Although the present invention will be described with reference to detecting the presence of a hand, it should be appreciated that other body parts and/or objects, such as artificial limbs, can also be detected with the sensor system 35. When polarized light reflects off a rough, light scattering object, such as a hand H, the reflected light tends to be unpolarized. The sensor system 35 takes advantage of this property, when detecting for the presence of hands H or other objects.

As mentioned before, the intensity of the light reflected from an object varies based on the distance of the object from the sensor system 35. Other conditions, like the reflectivity of the object and/or ambient conditions, also affect the intensity of the reflected light such that typical automatic faucet systems are unable to distinguish between highly reflective objects located far away from the system from dull objects located in close proximity (and vice-versa). In the illustrated embodiment, the sensor system 35 not only uses polarization to distinguish between actual and false objects, but also further detects the position or distance of the object from the sensor along with the intensity of the reflected light. By doing so, the sensor system 35 eliminates a number of sources of false readings, which in turn improves the performance of the sensor system 35.

To determine the location of a target object, the sensor system 35 can utilize a number of position sensing techniques. For instance, triangulation is used in one embodiment to locate the distance of the target. In one form, triangulation sensors determine the position of a target by measuring light reflected from the target surface. A transmitter, such as a diode, projects a spot of light to the target, and the reflected light is focused via an optical lens on a light sensitive device or receiver. In one form, a position sensitive detector or device (PSD), either a one or two-dimensional type, is used to sense the reflected light, and in another form, a charge coupled device (CCD) senses the reflected light. It should be recognized that other types of light sensors for detecting position can be used. If the position of the target changes from a reference point the position of the reflected spot of light on the detector changes in turn. Electronics in the sensor system 35 and/or the controller 36 detect the spot position of the reflected light on the sensor and, following linearization and additional digital or analogue signal conditioning, provides an output signal proportional to the position of the targeted object.

Figure 2:
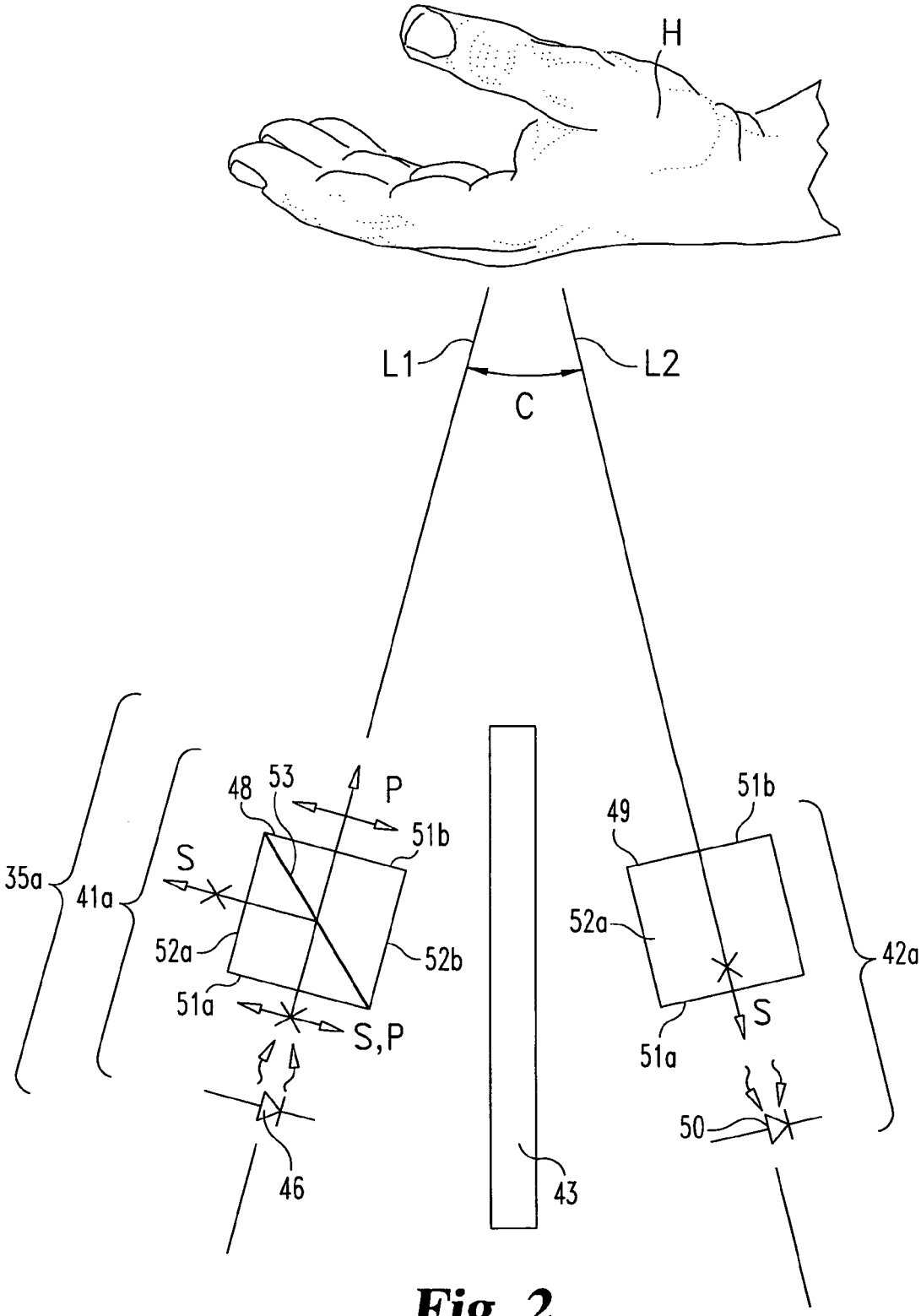
FIG. 2 is a top elevational view of a sensor system used in the FIG. 1 faucet system.
Figure 3:
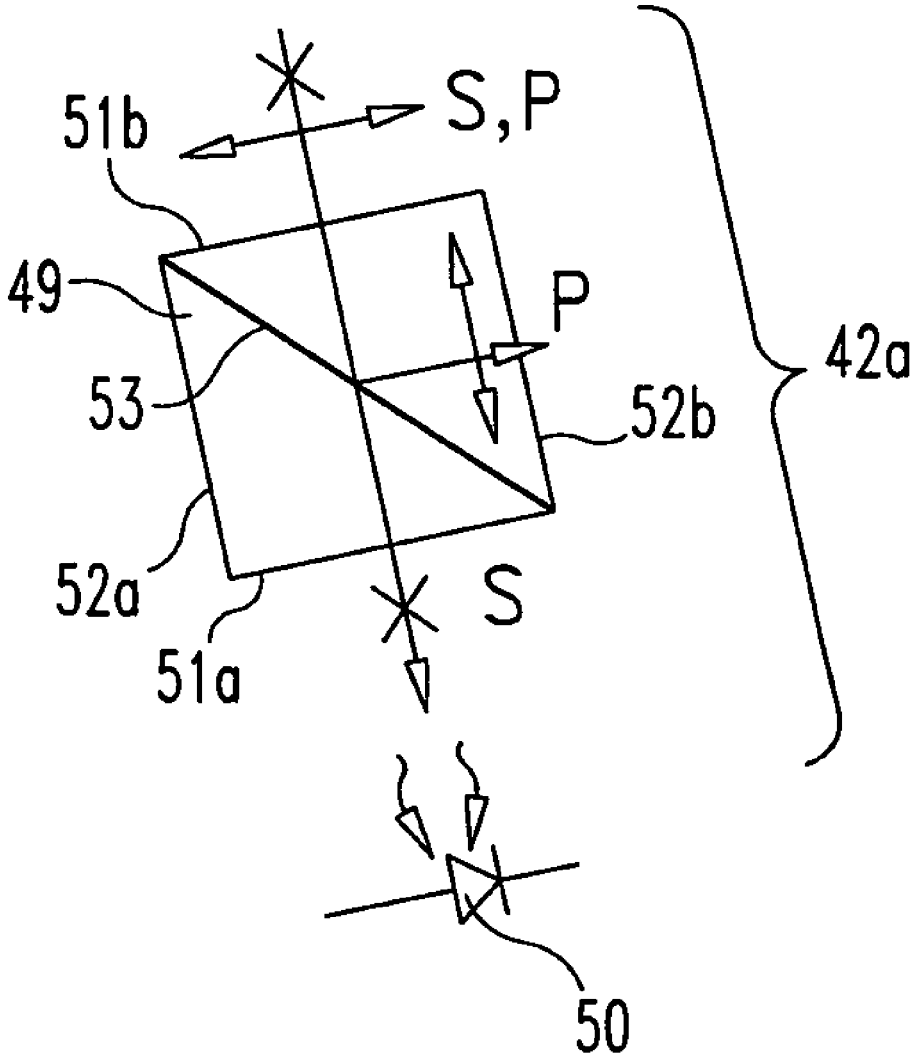
FIG. 3 is a side elevational view of a detector used in the FIG. 2 system.

A sensor system 35*a*, according to one embodiment, is illustrated in FIGS. 2 and 3. As shown, sensor system 35*a* includes an emitter subsystem 41*a* for transmitting p-polarized light P (i.e., the light field electric vector is in the plane of the sensor system 35*a*) and a detector subsystem 42*a* that is configured to sense s-polarized light S (i.e., the light field electric vector is in a plane orthogonal with respect to the plane of the sensor system 35*a*). The sensor system 35*a* can detect and analyze polarized light using a number of techniques. For example, the sensor system 35*a* can detect and analyze light through selective absorption, reflection (i.e., using Brewster's angle), double refraction, and/or scattering techniques, to name a few. In the illustrated embodiment, both the emitter subsystem 41*a* and the detector subsystem 42*a* are operatively coupled to the controller 36 via operative connection 39. The emitter subsystem 41*a* in FIG. 2 is operable to emit a beam of p-polarized light P. In one embodiment, the light from the emitter subsystem 41*a* is emitted as a series of pulses, but it is contemplated that the light can be emitted as a continuous beam and/or in other forms. Referring to FIG. 2, the detector subsystem 42*a* is configured to detect s-polarized light S, that is, light polarized in an orthogonal direction with respect to the p-polarized light P. In the illustrated embodiment, the polarity of the light emitted from the emitter subsystem 41*a* and the light detected by the detector subsystem 42*a* will be described as being perpendicular to each another. However, it should be appreciated that the sensor subsystems 35 in other embodiments can also detect the presence of the hand H when the polarities of the emitted and sensed light are not orthogonal with respect to one another, but are still different from one another (i.e., not in a 0° or 180° phase relationship). The sensor system 35*a* is configured to transmit and detect infrared (IR) light, but is should be appreciated that in other embodiments, the sensor systems 35 can transmit and detect other forms of radiation, such as visible light. As depicted, the emitter subsystem 41*a* and the detector subsystem 42*a* are separated by an opaque barrier 43. The opaque barrier 43 prevents stray emissions from the emitter subsystem 41*a* from directly hitting the detector subsystem 42*a*.

With reference to FIG. 2, the emitter subsystem 41*a* includes a beam generator 46 that is positioned proximal to an emitter polarizer 48. The beam generator 46 generates a beam of light, and the emitter polarizer 48 polarizes the light from the beam generator 46. Although illustrated as separate components, it should be appreciated that the beam generator 46 and the emitter polarizer 48 can be integrated into a single component. The beam generator 46 in the embodiment shown is operatively coupled to the controller 36 via the operative connection 39. In the embodiment depicted, the beam generator 46 includes a photo diode emitter. However, it is contemplated that beam generator 46 can include other light emitting means, such as incandescent lamps, fluorescent lamps, mercury lamps, and/or lasers, to name a few. In the illustrated embodiment, the beam generator 46 emits unpolarized light (S, P), that includes both p-polarized and s-polarized light as well as other polarizations of light. The emitter polarizer 48 polarizes the light emitted from the beam generator 46 so that only a p-polarized light beam P is emitted from the emitter subsystem 41*a*. In the illustrated embodiment, the emitter polarizer 48 includes a polarizing beam splitter, and the emitter polarizer 48 in another embodiment includes a thin polarizing film. The emitter polarizing beam splitter 48, in the illustrated embodiment, divides unpolarized light (S, P) into two orthogonally polarized beams, s-polarized and p-polarized, that are polarized at ninety degrees (90°) with respect to one another. The s-polarized light S is not transmitted. Rather, the s-polarized light S is reflected at an orthogonal direction with respect to the p-polarized beam, and in one particular embodiment, after being reflected, the s-polarized light S is absorbed by an absorbing material. As depicted in FIG. 2, the p-polarized light P is transmitted to detect the presence of hand H.

The detector subsystem 42*a* is operable to detect the presence of s-polarized light S reflected off the hand H. In one embodiment, the detector subsystem 42*a* is further operable to detect the distance or position of the hand H. Referring to FIG. 2, the detector subsystem 42*a* includes a detector polarizer 49 and a beam detector 50. Although described as separate components, it should be appreciated that the detector polarizer 49 and the beam detector 50 can be integrated into a single component along with other components. In the illustrated embodiment, the detector polarizer 49 is a polarizing beam splitter, and in another embodiment, the detector polarizer 49 is a thin polarizing film. A polarizing beam splitter has the property that it transmits light polarized in one direction and reflects light polarized in the orthogonal direction. Usually, p-polarized light is transmitted and the s-polarized light is reflected. Nevertheless, in other types of beam splitters, the s-polarized light can be transmitted instead. Such a polarizing beam splitter usually has a cubic shape, with the angle of incidence on a polarizing coating being forty-five degrees (45°). The polarizing coating comprises a multi-layer stack of dielectric materials having high and low refractive indices. The dielectric coating stack is optimized to give a wide separation of the reflectance of the s-polarized and p-polarized light, and at the same time, maintain a large difference in their reflectance. When in the form of polarizing beam splitters, each polarizer 48, 49 has opposing end surfaces 51 and opposing sidewall surfaces 52 that generally extend in an orthogonal direction with respect to surfaces 51. As shown in FIGS. 2 and 3, each polarizer 48, 49 further has a beam splitting surface 53, which is coated with a polarizing coating. Surfaces 51 include a first end surface 51*a* and an opposing, second end surface 51*b* that faces the object to be detected (hand H). The beam splitting surface 53 in the illustrated embodiment extends between the first 5*a* and second 5*b* end surfaces at approximately a forty-five degree (45°) angle. The sidewall surfaces 52 can be further categorized as an first sidewall surface 52*a*, which is on the same side of the beam splitting surface 53 as the first end surface 51*a*, and a second sidewall surface 52*b*, which is on the same side of the beam splitting surface 53 as the second end surface 5*b*.

In the emitter subsystem 41*a*, the beam generator 46 faces the first end surface 51*a* of the emitter polarizer 48. As shown, the beam detector 50 faces the first end surface 5*a* of the detector polarizer 49. In one embodiment, the beam detector 50 includes a positive-intrinsic-negative (PIN) photo diode. In another embodiment, the beam detector 50 includes a PSD and/or CCD to sense the relative position or distance of the hand H based on the reflected light. However, it is contemplated that the beam detector 50 can include other types of light detection means. The beam detector 50 in FIG. 3 is operatively coupled to the controller 36 via operative connection 39.

As shown in FIGS. 2 and 3, the detector polarizer 49 is configured to allow the beam detector 50 only to receive s-polarized light S. The detector polarizer 49 in FIG. 2 is oriented at ninety degrees (90°) relative to the emitter polarizer 48 such that the beam splitting face 53 of the detector polarizer 49 is rotated in a likewise fashion. FIG. 3 shows a side view of the detector polarizer 49 in the beam detector subsystem 42*a* of FIG. 2. By orienting the beam splitting face 53 of the detector polarizer 49 in such a manner, the p-polarized light P is reflected off the beam splitting surface 53 towards the second sidewall surface 52*b*. With reference to FIG. 3, when both s-polarized S and p-polarized P light is received at the second end face 51*b* of the detector polarizer 49, the p-polarized light component P is reflected away from the beam detector 50 so that only s-polarized light S is received at the beam detector 50. In one embodiment, the beam detector 50 is operatively coupled to the controller 36 via operative connection 39. To improve detection of the emitted beam and triangulate the location of the hand H, the emitter subsystem 41*a* and the detector subsystem 42*a* are angled towards one another such that their respective longitudinal axes L1 and L2 intersect one another to form a convergence angle C. In one embodiment, the convergence angle C is approximately ten degrees (10°), but it is contemplated that the convergence angle C can vary. In another embodiment, the longitudinal axis L1 of the emitter subsystem 41 and the longitudinal axis L2 of the detector subsystem 42 extend in a parallel relationship, and a separate sensor is used to determine the distance or location of the hand H.

During detection, the beam generator 46 in the illustrated embodiment generates an unpolarized IR beam (S, P), containing both s-polarized S and p-polarized P beam components (as well as other polarizations of light). The emitter polarizer 48 only transmits the p-polarized IR light P towards the target. As depicted in FIG. 2, the s-polarized light S from the beam generator 46 reflects off the beam splitting surface 53 and out the first side surface 52*a*; whereas the p-polarized light P passes through the beam splitting surface 53 and out the second end face 51*b*. If a highly reflective object, such as a sink bowl or a stream of water from the faucet 32, is present along the p-polarized beam path transmitted by the emitter subsystem 41*a*, then a highly p-polarized beam P is reflected off the object towards the beam detector subsystem 42*a*. At the detector polarizer 49, most of the reflected p-polarized light P is blocked from reaching the beam detector 50. Since the beam detector 50 does not sense the reflected light, the controller 36 does not supply water to the spout 32. When an object that tends to scatter light, such as hand H, is placed in front of the sensor system 35*a*, the p-polarized light P transmitted from the emitter subsystem 41*a* is scattered such that at least some s-polarized light S is reflected back towards the detector subsystem 42*a*. As shown in FIG. 3, the detector polarizer 49 allows the s-polarized light S to pass through surface 53 to the beam detector 50. Upon detection of the s-polarized light S at the beam detector 50, the controller 36 opens the valve 40 such that water is able to flow through the spout 32 and onto the hand H of the user. In one form, the controller 36 requires the s-polarized light S to reach a specified threshold level before activating the valve 40. Once the hand H is removed from the line of sight for the sensor system 35*a*, the reflected s-polarized light S from the hand H is no longer received at the beam detector 50, and as a result, the controller 36 shuts off the water supply to the spout 32.

Figure 4A:
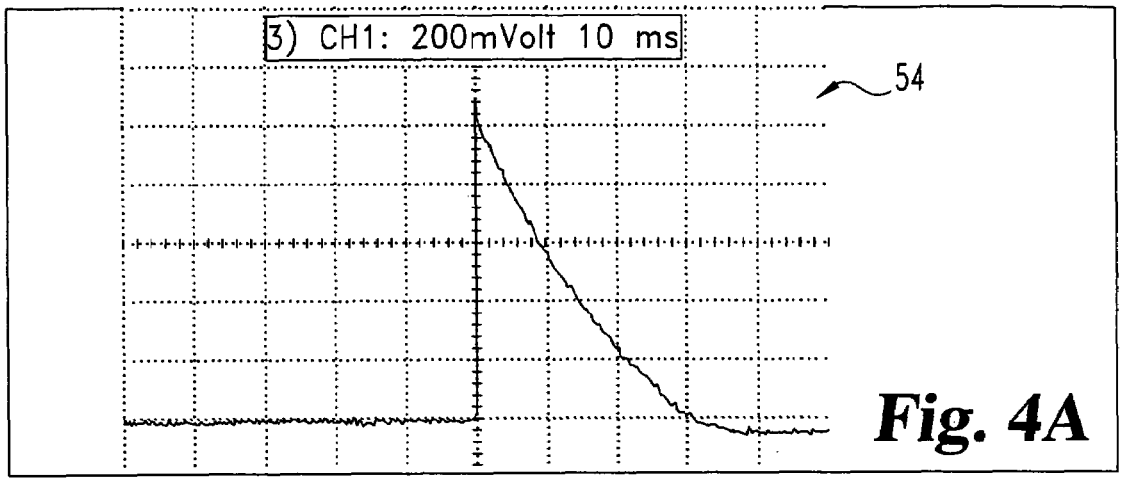
FIG. 4A is a graph illustrating the signal strength detected from a reflective object without the use of a polarizing filter.
Figure 4B:
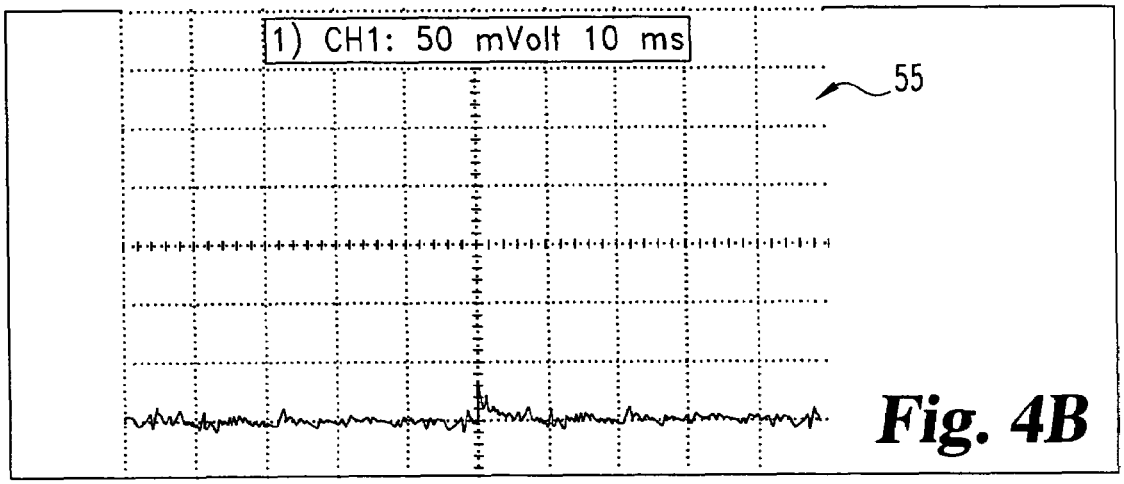
FIG. 4B is a graph illustrating the signal strength detected from the reflective object with the FIG. 3 detector.
Figure 4C:
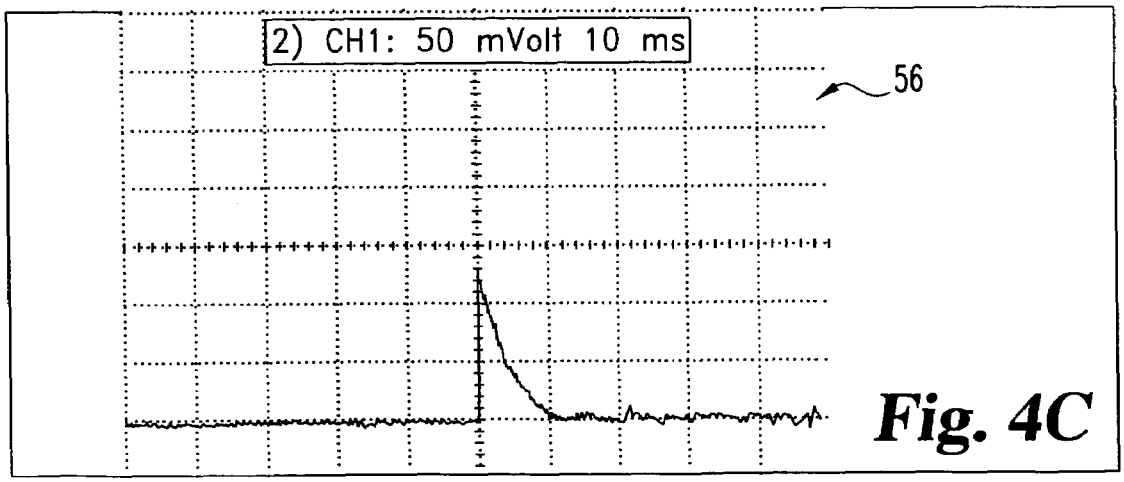
FIG. 4C is a graph illustrating the signal strength detected from a hand with the FIG. 3 detector.

Graph 54 in FIG. 4A illustrates the signal strength that is generated from a highly reflective mirror located about eight inches (8') from a sensor system that does not incorporate the detector polarizer 49. As shown in graph 54, a signal of about one-volt (1 V) is generated without the use of the detector polarizer 49. In FIG. 4B, graph 55 illustrates the signal strength that is generated from the highly reflective mirror located about eight inches (8') from the sensor system 35*a*, when the sensor system 35*a* incorporate the detector polarizer 49. Once the detector polarizer 49 is put in place, specular light from the mirror is nearly extinguished such that only a signal of about twenty-five millivolts (25 mV) is detected, as is depicted with graph 55. Graph 56 in FIG. 4C illustrates the signal strength when the palm of hand H is positioned approximately five inches (5') from the sensor system 35*a* that incorporates the detector polarizer 49. As shown in FIG. 4B, when the hand H is positioned in front of the sensor system 35*a*, a signal level of about one-hundred fifty millivolts (150 mV) is detected in a background of about twenty millivolts (20 mV). Thus, it should be appreciated that the sensor system 35*a* is able to detect and distinguish highly reflective (specular) items, such as a reflective sink, from scattering (diffusing) items, like the hand H of the user.

As mentioned before, the intensity or strength of the reflected light can vary based on the distance of the target object from the sensor 35*a* as well as the reflectivity of the object. Even with light scattering objects, like the hands H, the intensity of reflected light can vary from object to object. For example, persons with lighter complexions tend to reflect more visible light from their hands H than those with darker complexions. To distinguish between light diffusing items that are far away from the sensor 35*a*, but reflect a considerable amount of light, from closer, but dimmer diffusing items (and vice-versa), the sensor 35*a* triangulates the relative position of the target object, like the hand H. As the position of the hand H moves, the location of the spot of the s-polarized light S reflected on the beam detector 50 changes. The distance of the hand H, or other object, is determined based on the location of the spot relative to a reference location on the beam detector 50 that has a known reference distance. So for example, if the beam detector 50 senses s-polarized light S reflected from the hand H with an intensity that satisfies a threshold limit, but the beam detector 50 senses that the hand H is positioned far away from the spout 32, the controller 36 keeps the valve 40 closed so that water does not flow from the spout 32. Once the beam detector 50 senses that the hand H is positioned near to or under the spout 32, the controller 36 opens the valve 40 so that water flows from the spout 32. In one embodiment, the beam detector 50 only detects the location of the hand H along one dimension, such as the distance of the hand H from the sensor 35. In another embodiment, the beam detector 50 senses the location of the hand H along two dimensions, i.e., how far the hand H is from the sensor 35 and whether the hand H is located on either side of the spout 32. This allows the controller 36 to determine if the hand H is located directly under or close to the spout 32 to warrant initiation of water flow.

Figure 5:
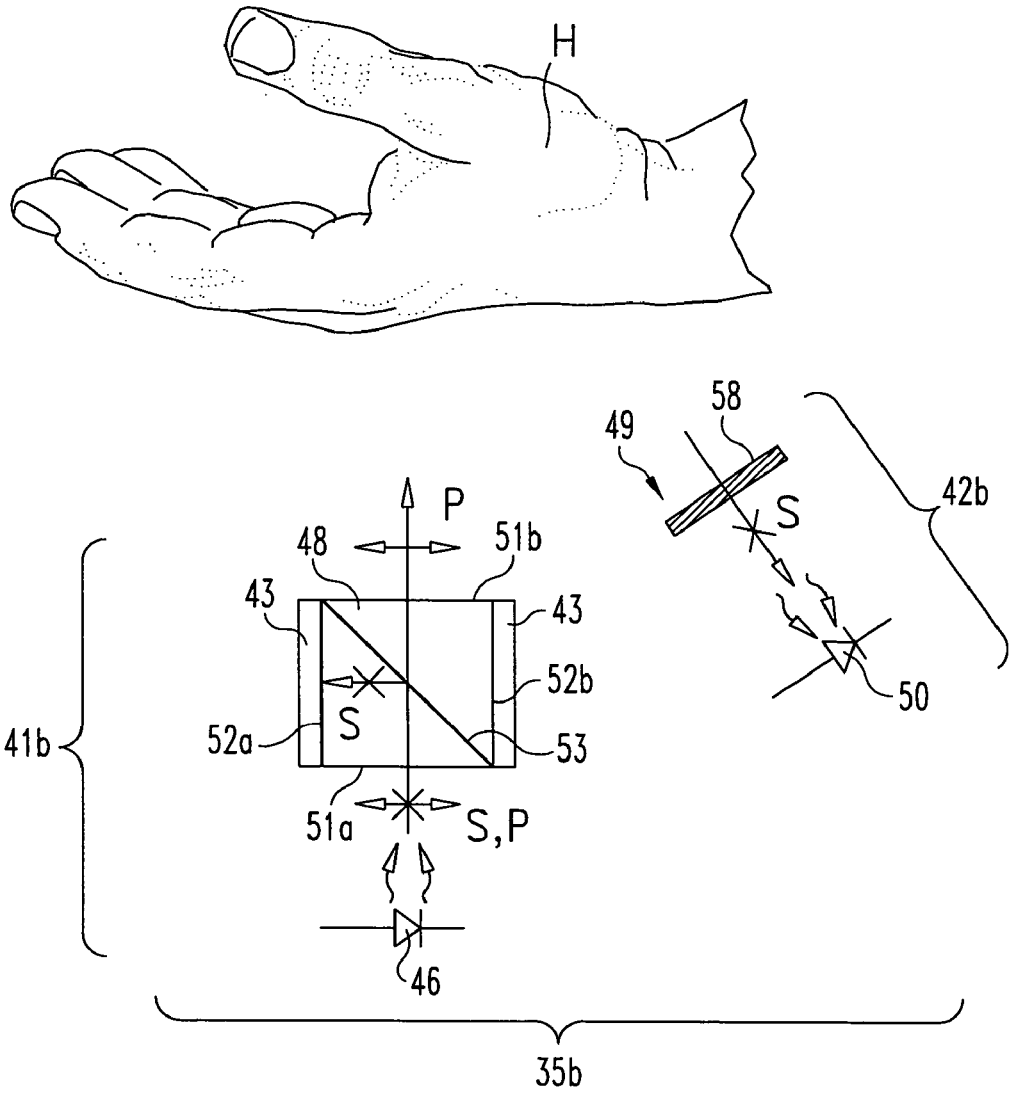
FIG. 5 is a top elevational view of a sensor system according to another embodiment.

FIG. 5 illustrates a sensor system 35*b* according to another embodiment of the present invention. Similar to the previous embodiment, the sensor system 35*b* in FIG. 5 includes an emitter subsystem 41*b* and a detector subsystem 42*b*. In the illustrated embodiment, the emitter subsystem 41*b* and the detector subsystem 42*b* are angled towards one another to permit triangulation for location detection. The emitter subsystem 41*b* includes the beam generator 46 and emitter polarizer 48 of the type described above. Opaque barriers 43 are positioned on both sidewalls 52 of the emitter polarizer 48 such that only a p-polarized beam P is emitted from the emitter subsystem 41*b*. As illustrated, the opaque barriers 43 absorb the s-polarized beam S as well as prevent stray emissions from hitting the detector subsystem 42*b*. In the detector subsystem 42*b*, the polarizer 49 includes a polarizing sheet 58 that allows only s-polarized light S to strike the beam detector 50. The sensor system 35*b* illustrated in FIG. 5 operates in a fashion similar to the embodiment described above. The beam generator 46 generates an unpolarized beam (S, P), and the emitter polarizer 48 separates out the p-polarized beam component such that only a p-polarized beam P is emitted from the emitter subsystem 41*b*. If a reflective object is placed in front of the p-polarized beam P from the emitter subsystem 41*b*, then only p-polarized light is reflected to the detector subsystem 42*b*. The polarizing sheet 58 blocks the reflected p-polarized light P from landing on the beam detector 50. With little or no light striking the beam detector 50, the controller 36 keeps the valve 40 closed so that no water is supplied to the spout 32. In contrast, if a light scattering object, such as hand H, is placed in front of the p-polarized beam P from the emitter subsystem 41*b*, then at least some s-polarized light S is reflected by the hand H. The reflected s-polarized light S is able to pass through the polarizing sheet 58 and strike the beam detector 50. The beam detector 50 senses both s-polarized light S as well as determines the relative location of the hand. Upon sensing the s-polarized light S above a threshold level at the beam detector 50 and determining that the hand H is close enough, the controller 36 opens the valve 40 to allow water to flow from the faucet spout 32. Once the hand H is removed from the line of sight of sensor system 35*b*, the controller 36 turns off the water from the spout 32.

Figure 6:
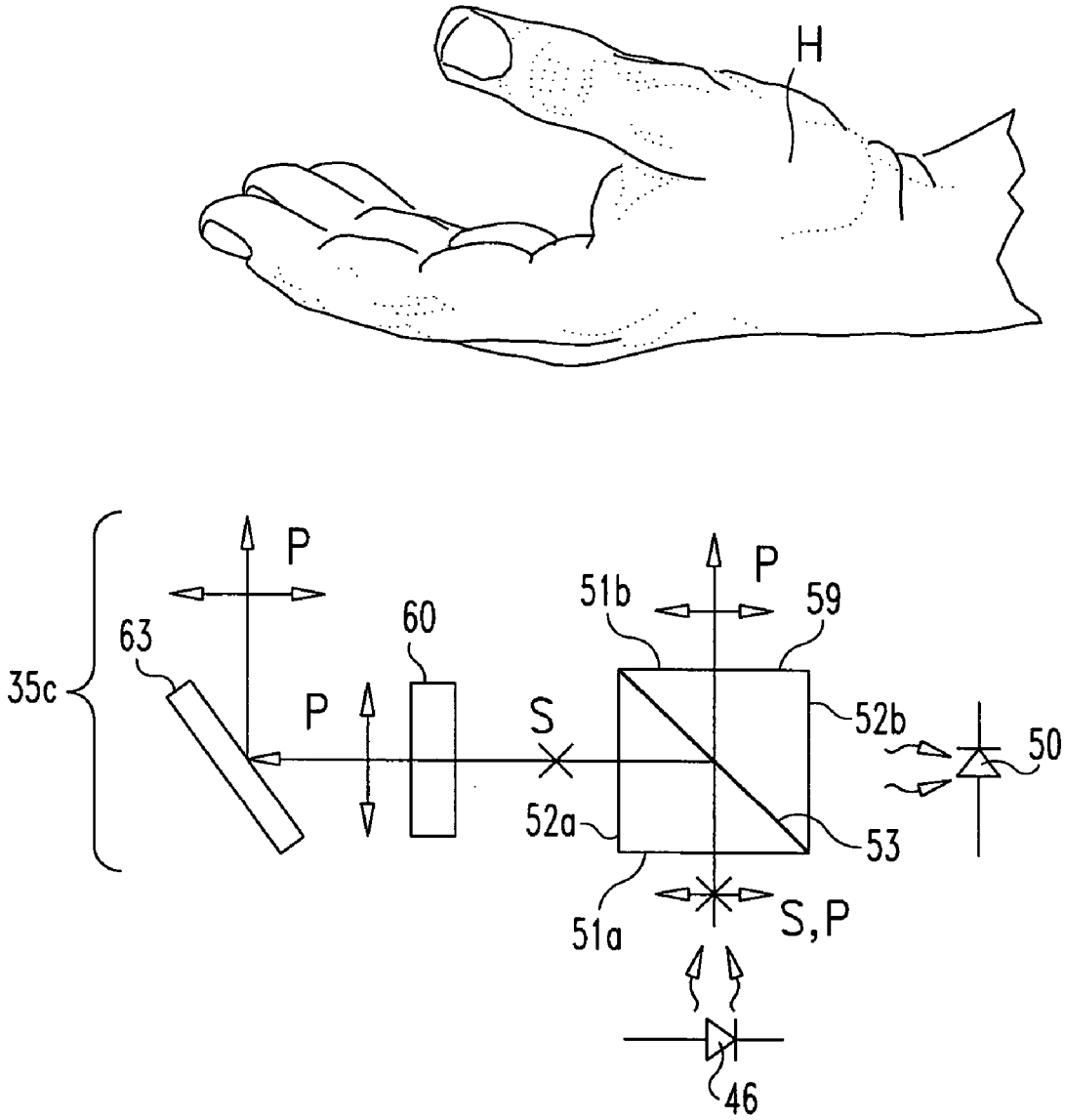
FIG. 6 is a top elevational view of a sensor system according to a further embodiment.
Figure 7:
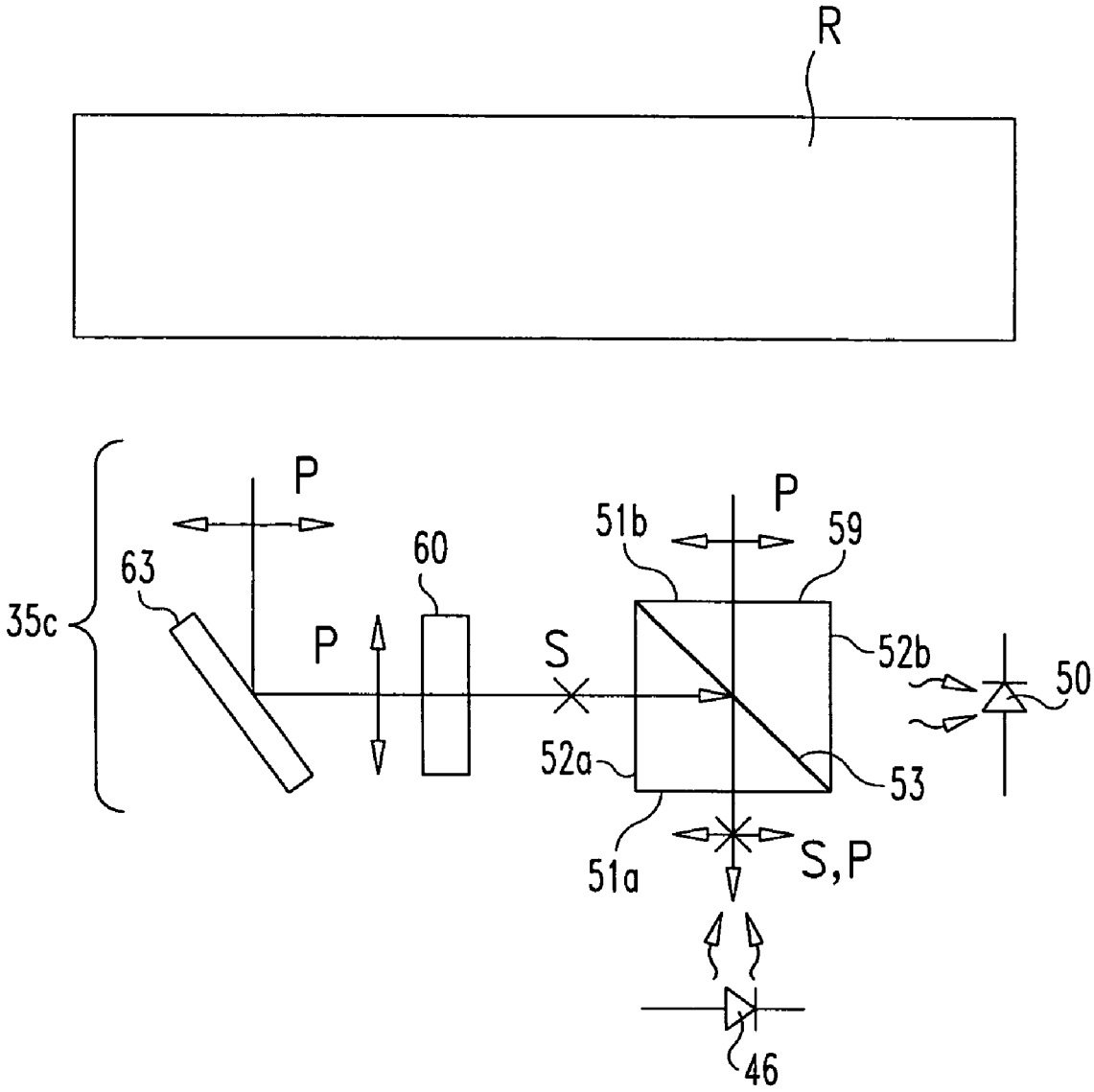
FIG. 7 is a top elevational view of the FIG. 6 sensor system when sensing reflective objects.
Figure 8:
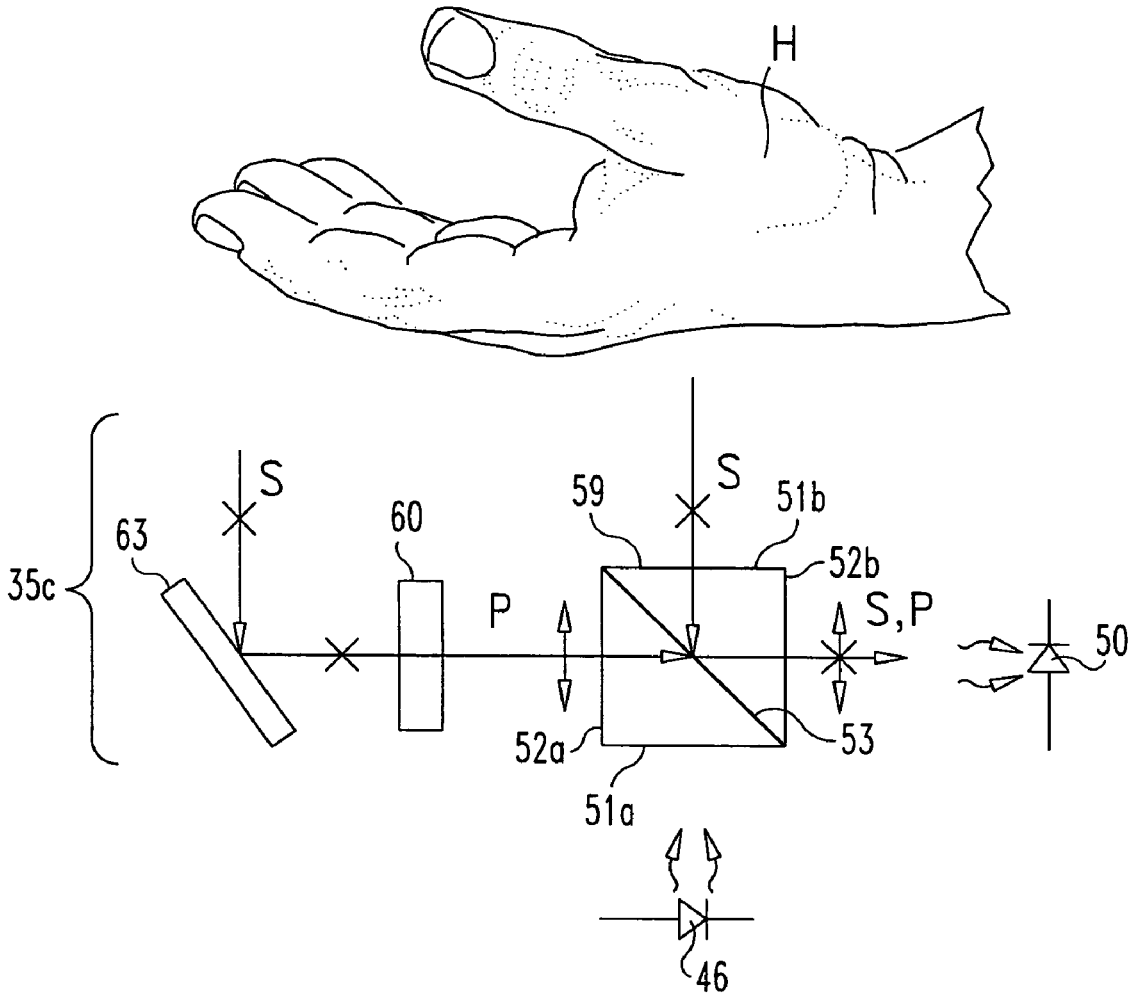
FIG. 8 is a top elevational view of the FIG. 6 sensor system when detecting light scattering objects.

FIGS. 6, 7 and 8 illustrate a sensor system 35*c* according to a further embodiment. In the embodiment illustrated in FIG. 6, both the beam emitting and detecting polarizing functions are integrated into a combined emitter/detector polarizer 59. The emitter/detector polarizer 59 in the illustrated embodiment is a polarizing beam splitter that, like the previous embodiments, has first 51*a* and second 51*b* end walls that are separated by beam splitting surface 53. First sidewall surface 52*a* is located on the same side of the beam splitting surface 53 as the first end surface 51*a*, and second sidewall surface 52*b* is located on the same side of the beam splitting surface 53 as the second end surface 51*b*. As shown, system 35*c* includes beam generator 46 as well as beam detector 50. The beam generator 46 faces the first end wall 51*a*, and the beam detector 50 faces the second sidewall 52*b*. As will be appreciated from the discussion below, system 35*c* increases the amount of p-polarized light P generated as well as the amount of s-polarized light S received by system 35*c*. Facing the first sidewall 52*a*, system 35*c* has a half-wave plate 60 and a mirror 63 for reflecting light to and from the area to be monitored. As one should appreciate, the half-wave plate 60 rotates the plane of polarization ninety degrees (90°) such that, for example, p-polarized light is converted to s-polarized light. During detection, the beam generator 46 generates unpolarized light (S, P). Beam splitter 59 separates the unpolarized light into p-polarized and s-polarized components. As shown, the p-polarized light P passes through the beam splitting surface 53; whereas the s-polarized light S is reflected off the beam splitting surface 53 towards the half wave plate 60. As the s-polarized light S passes through the half-wave plate 60, the s-polarized light's plane of polarization is rotated so as to become a p-polarized beam P. The mirror 63 reflects the now p-polarized beam P towards the detection area. With this design, the light output from system 35*c* is approximately doubled. In the illustrated embodiment, the p-polarized light P from both the mirror 63 and the emitter/detector polarizer 59 travel in a parallel direction. Nonetheless, in other embodiments, it is contemplated that the mirror 63 and polarizer 59 can be angled so that both p-polarized beams P converge to intersect one another so that triangulation can be formed to locate the targeted object. In still yet other embodiments, a separate sensor can be used to locate the targeted object.

Referring to FIG. 7, when a highly reflective object R, like a sink or a stream of water, is placed in front of the sensor system 35*c*, most of the light from the beam generator 46 that is reflected off the reflective object R is p-polarized light P. The p-polarized light P reflected off object R can be received along two different paths. In the first path, the p-polarized light P directly strikes the second end face 51*b* of the combined emitter/detector polarizer 59 and passes straight through the beam splitting surface 53 onto the beam generator 46. In the second path, some of the p-polarized light P from object R is reflected by the mirror 63 towards the half-wave plate 60. The half-wave plate 60 rotates the plane of polarization of the p-polarized light P from the mirror 63 so that the beam becomes an s-polarized beam S. The now s-polarized beam S is then reflected off the beam splitting surface 53 towards the beam generator 46. Consequently, little to no light is detected at the beam detector 50, and the controller 37 does not supply water to the spout 32.

When a light scattering object is placed in front of sensor system 35*c*, such as hand H in FIG. 8, a significant amount of the p-polarized light P from the system 35*c* is reflected back as s-polarized light S. As shown in FIG. 8, the s-polarized light S that is reflected from the hand H towards the combined polarizer 59 is reflected off the beam splitting surface 53 towards the beam detector 50. The s-polarized light S that is collected by the mirror 63 is reflected through the half-wave plate 60, thereby converting the light to p-polarized light P. The now p-polarized light P passes straight through the beam splitting surface 53 and is collected on the beam detector 50. Upon detection of light on the beam detector 50, the controller 36 turns on the water supply to the spout 32. Once the hand H is removed, the controller 36 turns off the water supply. As should be appreciated, system 35*c* increases the efficiency in the amount of light generated as well as detected.

Figure 9:
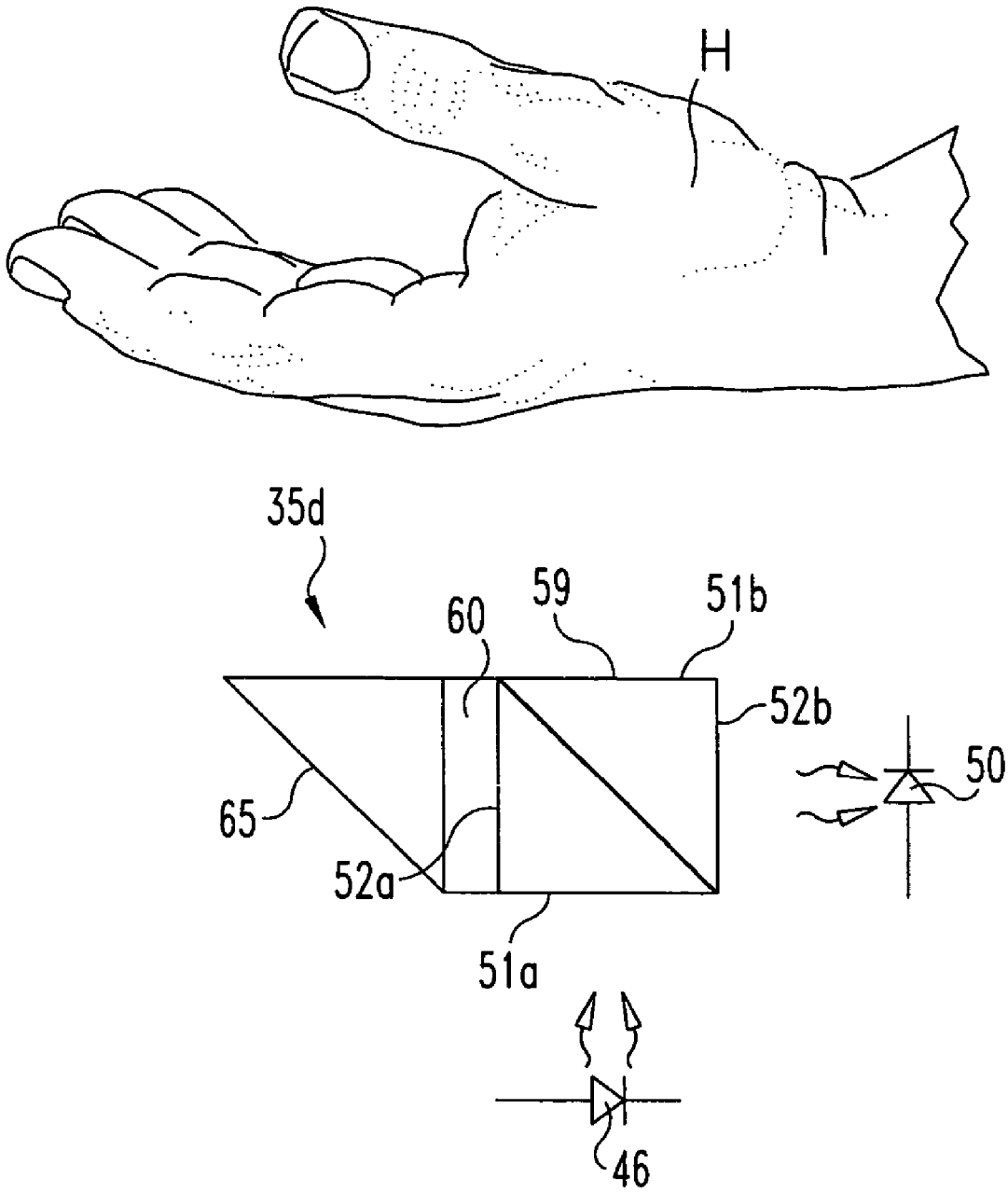
FIG. 9 is a top elevational view of a polarizing sensor according to another embodiment.

FIG. 9 illustrates a sensor system 35*d* according to another embodiment that is similar to the one described above with reference to FIGS. 6, 7 and 8. Like the FIG. 6 system 35*c*, the sensor system 35*d* in FIG. 9 includes beam generator 46, beam detector 50, polarizer 59 and half-wave plate 60. However, instead of a mirror 63, system 35*d* includes a folding prism 65 that is used to redirect the light. Moreover, the half-wave plate 60 contacts both the folding prism 65 and the polarizer 59. System 35*d* in FIG. 9 operates in the same fashion as the system 35*c* described above with reference to FIGS. 6, 7 and 8, with the folding prism 65 redirecting light in the same manner as the mirror 63. It is contemplated that the prism 35 can angle the light so that location determination of an object can be performed and/or a second sensor can be used to locate the object.

Figure 10:
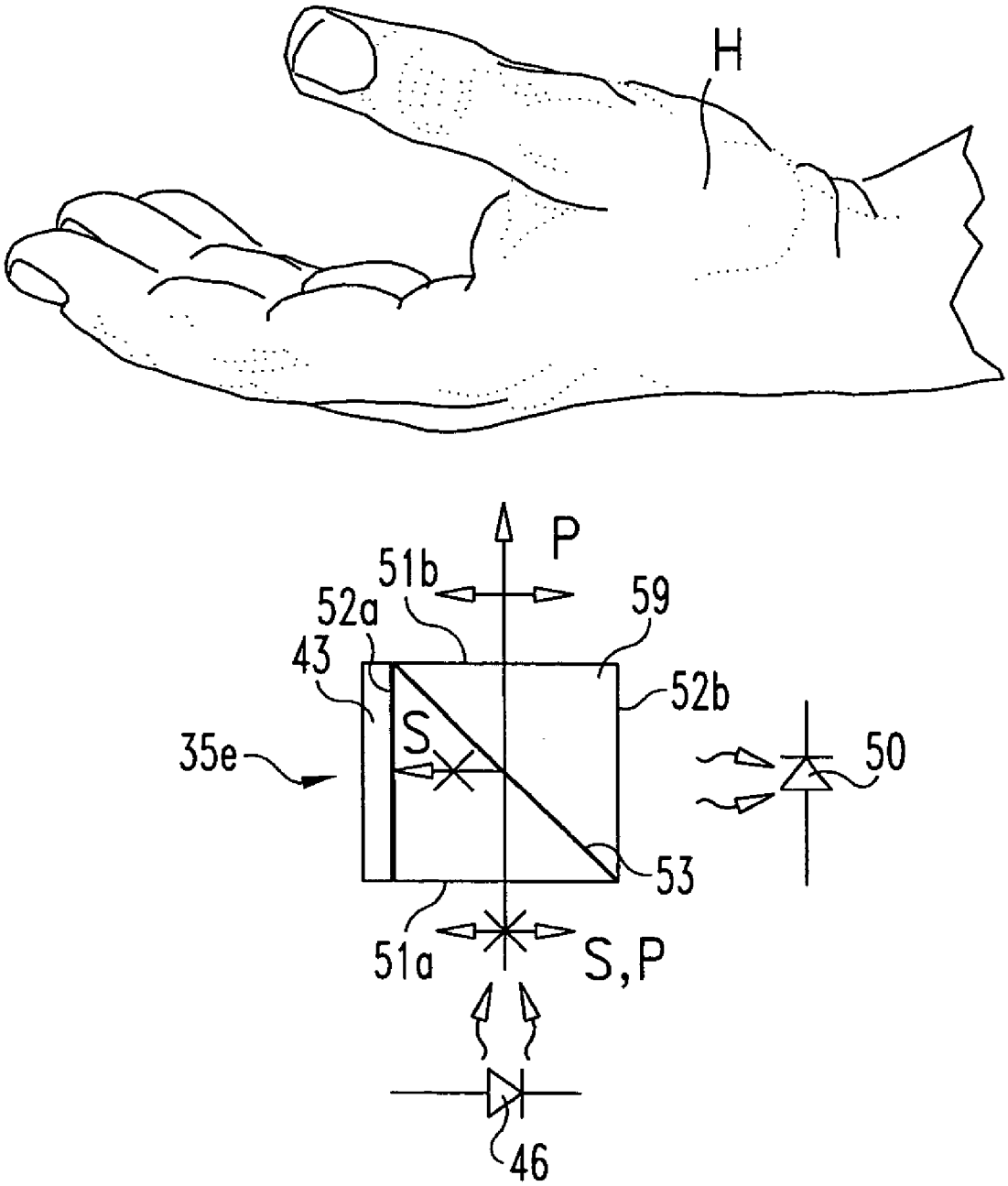
FIG. 10 is a top elevational view of a sensor system according to a further embodiment.
Figure 11:
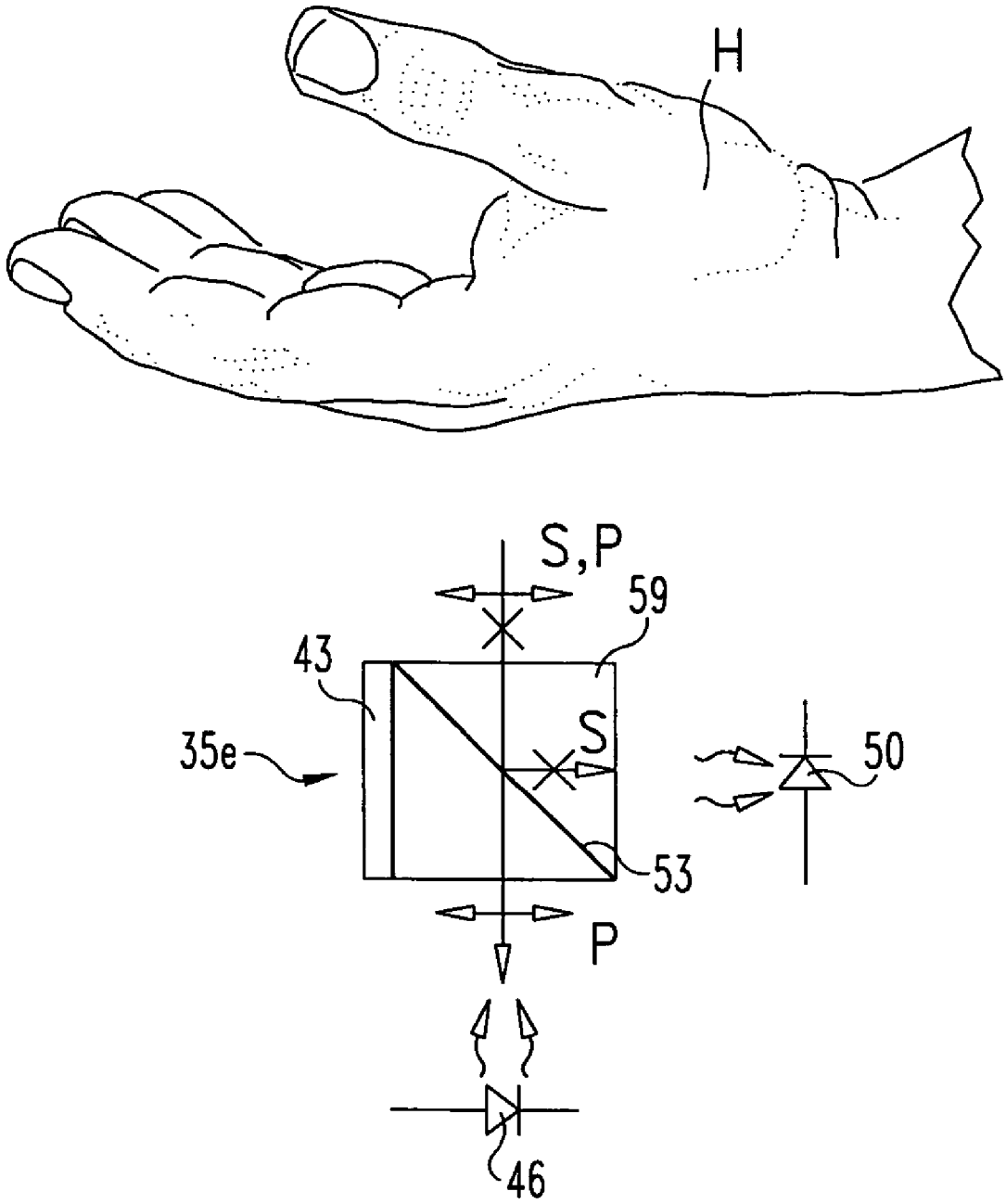
FIG. 11 is a top elevational view of the FIG. 10 sensor system when detecting light scattering objects.

A sensor system 35*e*, according to a further embodiment, will now be described with reference to FIGS. 10 and 11. System 35*e* includes beam generator 46, beam detector 50, emitter/detector polarizer 59, and opaque barrier 43. The beam generator 46 faces the first end face 51*a*. As illustrated in FIG. 10, the beam detector 50 faces the second sidewall 52*b*, and the opaque barrier 43 covers the first sidewall 52*a*. When the beam generator 46 generates a beam of unpolarized light (S, P), the s-polarized light S is reflected off the beam splitting surface 53 and is absorbed by the opaque barrier 43. P-polarized light P passes through the beam splitting surface 53 and is emitted by sensor system 35*e*. When a light scattering object, such as hand H, is placed in front of the sensor system 35*e*, the reflected s-polarized light S from the hand H is reflected off the beam splitting surface 53 towards the beam detector 50. Upon detection of the s-polarized light S at the beam detector 50 (FIG. 11), the controller 36 turns on the water supply to the spout 32. Any reflected p-polarized light P travels directly through the beam splitting surface 53 in the polarizer 59 and does not strike the beam detector 50. So, for example, when a stream of water from the spout 32 pours in front of the sensor system 35*e*, mostly p-polarized light P is reflected back to polarizer 59. The reflected p-polarized light P does not strike the beam detector 50, and as a result, the controller 36 does not turn on the water supply to the spout 32. Likewise, when no object is present to reflect light back to sensor system 35*e*, the controller 36 does not supply water to the spout 32. It is envisioned that lenses can be used in other embodiments to create a convergence angle between the transmitted and received light so that triangulation can be performed for locating target objects. Location determination in still yet other embodiments can be performed through one or more separate location sensors.

Figure 12:
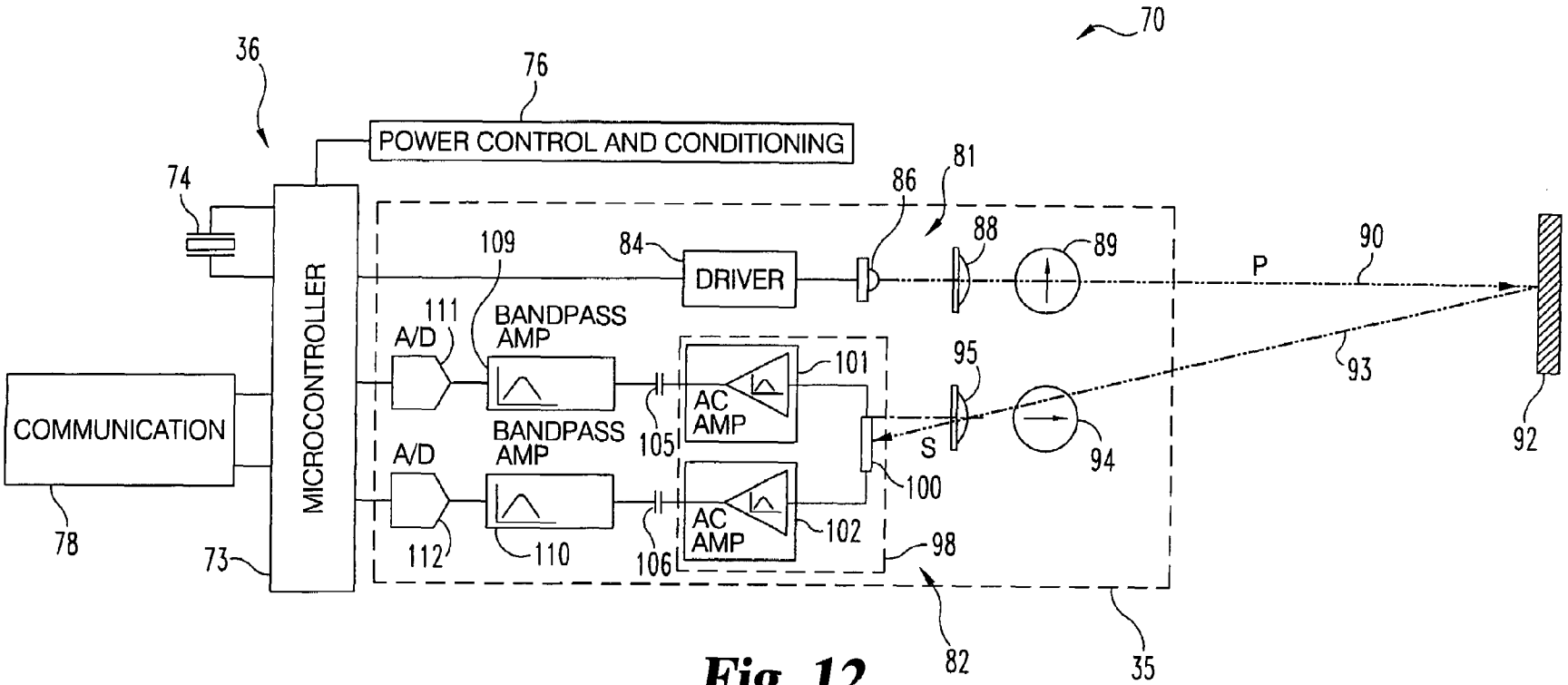
FIG. 12 is a schematic view of a sensor system according to another embodiment.

An automatic faucet system 70 according to still yet another embodiment is depicted in FIG. 12. Like the previous embodiments, the automatic faucet system 70 in FIG. 12 has sensor 35 and controller 36 portions. The components in the system 70 can be operatively coupled together in any number of ways, such as for example through wired connections, wireless connections or a combination thereof, including, but not limited to, electrical and optical forms of communication. As shown, the controller portion 36 includes a microcontroller 73 with a clock 74 that is configured to control the operation of the system 70. A power supply 76 is operatively coupled to the microcontroller 73 for supplying and conditioning power for the system 70. A communication port or bus 78 is operatively coupled to the microcontroller 73 for communicating with other systems, like the flow control valve 40, through a wired and/or wireless connection. As should be recognized, the microcontroller 73 in other embodiments can be directly coupled to the valve 40 so that the microcontroller 73 can directly control the valve 40.

Looking at FIG. 12, the sensor portion 35 generally includes two subsystems, an emitter subsystem 81 and a detector subsystem 82, which are both operatively coupled to the microcontroller 73. The emitter subsystem 81 includes a driver 84 for driving a light emitting diode (LED) 86. As depicted, the driver 84 is operatively coupled between the microcontroller 73 and the LED 86. In one embodiment, the LED 86 transmits visible light, and by transmitting visible light, a user is able to determine if their hands or other body part is in range to operate the automatic faucet system 70. For example, when the user sees a spot of light on their hand, they know that their hand is properly located. In other embodiments, the LED 86 can transmit invisible forms of light, like infrared, and/or other types of polarizable forms of radiation or energy. In the illustrated example, the LED 86 transmits pulses of light, particularly at a frequency of about 100 kHz, but in other forms, the LED 86 can transmit a continuous beam of light or pulse the light at different frequencies. The LED 86 in one embodiment includes an LED manufactured by Kingbright Corporation, part number APTD3216SURC, but it should be appreciated that other types of LED's can be used. To focus the light generated from the LED 86, the emitter subsystem 81 includes a lens 88 that is positioned between the LED 86 and a polarizer 89. The lens 88 focuses the light from the LED 86 on the polarizer 89, which then polarizes the light. In the illustrated embodiment, the polarizer 89 for the emitter subsystem 81 transmits p-polarized light P, as is indicated by arrow 90, onto a target object 92. However, it should be recognized that the polarizer 89 can polarize the light from the LED 86 to have a different polarity.

A portion of the light reflected from the target object 92, such as a hand, reflects back onto the detector subsystem 82, as is indicated by arrow 93. The detector subsystem 82 includes a polarizer 94 that filters the reflected light 93 so that light only having a specified polarization is able to pass through. Both polarizers 89 and 94 in one embodiment are polarizers made by Edmunds Industrial Optics, part number G45-204, but it is contemplated that other types of polarizers can be used. In the illustrated example, the polarizer 94 of the detector subsystem 82 only allows s-polarized light S to pass through. It should be recognized, however, that the polarizer 94 can filter the reflected light 93 so that other light polarities are received, so long as the polarity does not match the polarity of light transmitted from the polarizer 89 of the emitter subsystem 81. The detector subsystem 82 further includes a lens 95 for focusing the polarized light onto a PSD integrated detector 98. As shown, the lens 95, which is disposed between the polarizer 94 and the PSD 98, is positioned slightly offset from the center of the PSD 98 for triangulation purposes. As should be appreciated, however, the emitter 81 and detector 82 subsystems can be configured in other manners and/or include additional optical components (or omit components) for triangulation purposes. In the FIG. 12 embodiment, the PSD 98 is a one-dimensional PSD, and in one form, the PSD 98 is a PSD manufactured by iC-Haus, part number IC-OD 04CD BGA. The PSD 98 in FIG. 12 includes a photodiode 100 with two current outputs that have currents proportional to the location where the reflected light 93 strikes the photodiode 100. With one dimensional PSD's, the location of the targeted object 92 in one embodiment can be determined using Equation 1 below, for example.

$$\text{Position} = \left(\frac{x_1 - x_2}{x_1 + x_2}\right)\frac{L}{2} \qquad \text{Equation (1)}$$

where:

$x_1$ = output current 1

$x_2$ = output current 2

$L$ = length of $PSD$

Other types of equations can be used to determine the location in other embodiments.

Again, it should be realized that other types of position sensors, like two-dimensional PSD's as well as other types PSD's and CCD's for example, can be used. The PSD 98 further includes first 101 and second 102 photocurrent amplifiers (AC-Amp) with analog outputs that directly offer the amplified AC photoelectric current. In the photocurrent amplifiers 101, 102 of the embodiment shown, readings from constant light along with low frequency varying light are suppressed by a high pass filter, and a low pass filter reduces high-frequency interference. As mentioned before, the LED 86 in one example pulses the transmitted light 90 at a frequency of about 100 kHz, and likewise, the PSD 98 is designed with maximum sensitivity for alternating-light signals (for AC photoelectric currents) of about 100 kHz. It is contemplated that the PSD 98 can have different sensitivities in other embodiments. The detector subsystem 81 further includes an AC coupling section with first 105 and second 106 capacitors operatively coupled to the first 101 and second 102 photocurrent amplifiers, respectively, to filter the direct current (DC) portions of the signals from the first 101 and second 102 photocurrent amplifiers. First 109 and second 110 band pass amplifiers are operatively coupled to the first 105 and second 106 capacitors, respectively. The microcontroller 73 is operatively coupled to the first 109 and second 110 band pass amplifiers through first 111 and second 112 analog to digital (A/D) converters.

With the PSD 98, the microcontroller 73 is able to monitor the position of the object 92 as well as the character of the reflected light 93 from the object 92 to determine whether the faucet should be activated. Returning to the previous example, the emitter subsystem 81 transmits p-polarized light P (90) via the polarizer 89. When the p-polarized light P is reflected off a light scattering object, like a hand, a portion of the now reflected light becomes s-polarized light S, which is received by the detector subsystem 82. Based on the intensity of s-polarized light sensed by the PSD 98, the microcontroller 73 determine whether the object 92 is a reflective object like water or a diffusing object, such as a body part. With the two signals from the PSD 98, the microcontroller 73 is further able to determine the location of the object. When the microcontroller 73 determines that a hand or other light scattering object is located within a specified distance range, the microcontroller 73 opens the valve 40 to allow the water to flow. Otherwise, the microcontroller 73 shuts off or keeps off the water supply to the faucet spout 32. In another embodiment, the microcontroller 73 is further configured to monitor for movement with the PSD 98 so as to determine if someone moved their hand or other light scattering object into position, or if the PSD 98 is simply sensing stationary object that is part of the environment. This allows the system 70 to further reduce the level of false positive readings.

It should be appreciated from the previous discussion that various features from above-described embodiments can be combined together to form different automatic sensing systems. Further, selected features can be omitted and/or additional features added to create other embodiments. For example, one or more beam splitters can replace the polarizers in the FIG. 12 embodiment. Again, as mentioned before, it should be recognized that the features of the above-described embodiments can be modified for incorporation into other automated systems.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An automatic water supply system, comprising:

an emitter configured to emit light having a first polarization toward an object;

a detector configured to detect reflected light from the object having a second polarization that is different from the first polarization, wherein the detector is configured to sense position of the object;

a controller operatively coupled to the detector, the controller being constructed and arranged to supply water upon sensing with the detector that the reflected light has the second polarization above a threshold level and that the position of the object is within range;

wherein the emitter includes a beam generator operable to generate unpolarized light, and a polarizer positioned proximal to the beam generator to polarize the unpolarized light to have the first polarization;

wherein the polarizer includes a polarizing beam splitter;

wherein the detector includes a beam detector;

wherein the polarizing beam splitter has opposing first and second end walls;

wherein the polarizing beam splitter has opposing first and second sidewalls;

wherein the polarizing beam splitter has a beam splitting surface that separates the first end wall and the first sidewall from the second end wall and the second sidewall;

wherein the beam generator faces the first end wall;

wherein the beam detector faces the second sidewall; and an opaque member covering the first sidewall.

2. An automatic water supply system, comprising:

an emitter configured to emit light having a first polarization toward an object;

a detector configured to detect reflected light from the object having a second polarization that is different from the first polarization, wherein the detector is configured to sense position of the object;

a controller operatively coupled to the detector, the controller being constructed and arranged to supply water upon sensing with the detector that the reflected light has the second polarization above a threshold level and that the position of the object is within range;

wherein the emitter includes a beam generator operable to generate unpolarized light, and a polarizer positioned proximal to the beam generator to polarize the unpolarized light to have the first polarization;

wherein the polarizer includes a polarizing beam splitter;

wherein the detector includes a beam detector;

wherein the polarizing beam splitter has opposing first and second end walls;

wherein the polarizing beam splitter has opposing first and second sidewalls;

wherein the polarizing beam splitter has a beam splitting surface that separates the first end wall and the first sidewall from the second end wall and the second sidewall;

wherein the beam generator faces the first end wall;

wherein the beam detector faces the second sidewall; and a half-wave plate facing the second sidewall.

3. The system of claim 2, further comprising a mirror facing the half wave plate to reflect light towards the object.

4. The system of claim 2, further comprising a folding prism facing the half wave plate to reflect light towards the object.

5. An automatic water supply system, comprising:

an emitter configured to emit light having a first polarization toward an object;

a detector configured to detect reflected light from the object having a second polarization that is different from the first polarization, wherein the detector is configured to sense position of the object;

a controller operatively coupled to the detector, the controller being constructed and arranged to supply water upon sensing with the detector that the reflected light has the second polarization above a threshold level and that the position of the object is within range;

wherein the emitter includes a beam generator operable to generate unpolarized light, and a polarizer positioned proximal to the beam generator to polarize the unpolarized light to have the first polarization; and an opaque barrier positioned between the emitter and the detector for isolating the emitter from the detector.

6. A method, comprising:

transmitting light having a first polarization toward an object;

detecting reflected light from the object has a second polarization that is different from the first polarization;

determining that the object is located within range based on the reflected light, wherein said determining that the object is located within the range includes tracking the position of the object by triangulating the position of the object with a position sensor;

supplying water in response to said detecting the reflected light has the second polarization and said determining that the object is located within the range; and sensing movement of the object to filter out stationary environmental conditions; and wherein said supplying the water further occurs in response to said sensing movement of the object.

7. The method of claim 6, wherein the first polarization is oriented perpendicular to the second polarization.

8. An automatic water supply system, comprising:

an emitter configured to emit light having a first polarization onto an object;

a detector configured to detect intensity of reflected light from the object having a second polarization that is different from the first polarization;

the detector including a position sensor configured to triangulate the position of the object based on where the reflected light from the object shines along the position sensor; and a controller operatively coupled to the detector, the controller being constructed and arranged to supply water upon sensing with the detector that the intensity of the reflected light with the second polarization is above an intensity threshold level and that the position of the object is within range, wherein the controller is configured to monitor for movement of the object with the position sensor to determine if the position sensor is sensing a stationary item that is part of the environment for reducing false readings.

9. The system of claim 8, wherein the position sensor include a position sensitive detector for sensing the position of the object along at least one dimension.

10. The system of claim 8, wherein the position sensor include a charge coupled device.

11. The system of claim 8, further comprising:

means for emitting the light having the first polarization, wherein the means for emitting the light includes the emitter;

means for detecting the intensity of the reflected light, wherein the means for detecting the intensity of the reflected light includes the detector;

means for triangulating the position of the object, wherein the means for triangulating the position of the object includes the position sensor; and means for supplying the water, wherein the means for supplying the water includes the controller.

12. A method, comprising:

transmitting light having a first polarization toward an object positioned near a faucet;

determining that the object is a body part by detecting reflected light from the object has a second polarization that is different from the first polarization;

determining that the body part is located within range of the faucet based on the reflected light, wherein said determining that the body part is located within the range of the faucet includes tracking the position of the object by triangulating the position of the body part with a position sensor;

sensing movement of the body part to filter out stationary environmental conditions; and supplying water from the faucet in response to said determining that the object is the body part, said determining that the object is located within the range, and said sensing movement of the body part.

* * * * *